US005997271A

United States Patent [19]

Taubmann et al.

[11] Patent Number: 5,997,271

[45] **Date of Patent: *Dec. 7, 1999**

[54] DEVICE FOR MANAGING MOLDS USED FOR MECHANICALLY PRODUCING MOLDED OBJECTS OF BUILDING MATERIAL

[76] Inventors: Georg Taubmann; Steffen Taubmann, both of Parkweg 6, D-98708 Gehren; Wolfgang Liniger, Bergrat-Voigt-Strasse 14, D-98693 Ilmenau, all of Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,344

[22] Filed: Jan. 27, 1997

[30] Foreign Application Priority Data

Feb. 2, 1996 [DE] Germany ..... 196 03 687
Jan. 12, 1997 [DE] Germany ..... 197 00 694

[51] Int. Cl.[6] ..... B28B 1/08

[52] U.S. Cl. ..... 425/169; 425/432

[58] Field of Search ..... 425/135, 169, 425/432

[56] References Cited

U.S. PATENT DOCUMENTS 5,309,369 5/1994 Kamiguchi et al. ..... 425/170
5,571,539 11/1996 Starkey ..... 425/135

FOREIGN PATENT DOCUMENTS

0368012A2 5/1990 European Pat. Off. .
0566308A3 10/1993 European Pat. Off. .
2613213 10/1977 Germany .
44 13 789A1 10/1995 Germany .
1-163004 6/1989 Japan .
2-106308 4/1990 Japan .
7-161745 6/1995 Japan .
WO 9429049 12/1994 WIPO .

*Primary Examiner*—James P. Mackey
*Attorney, Agent, or Firm*—Jordan and Hamburg LLP

[57] ABSTRACT

A device for managing mold operation for production of molded objects of building material, such as for example concrete, discourages tampering of data collected pertinent to use of a particular mold over time. Various relevant parameters of the manufacturing process are stored in a transponder during active use thereof on a building material machine, the transponder being non-detachably connected to the production mold. The transponder is fixed to the mold in a manner inhibiting tampering with data stored therein and shielding same from mechanically induced damage. The above arrangement of the device permits subsequent retrieval and utilization of the accumulated stored data with write/read equipment available only to authorized personnel.

11 Claims, 3 Drawing Sheets

DEVICE FOR MANAGING MOLDS USED FOR MECHANICALLY PRODUCING MOLDED OBJECTS OF BUILDING MATERIAL

BACKGROUND OF THE INVENTION

When molded objects, such as paving stones, hollow block stones, curb stones or other finished concrete parts are produced, the fresh concrete is poured into appropriate molds of steel, consolidated there and demolded once again. Such molded objects are produced by means of largely automated building material machines, in which the respective molds can be used interchangeably. It is generally customary that the producer of concrete products leases or purchases the molds from a manufacturer specializing in molds. For ascertaining the lease price, monitoring the service life of the mold and checking guarantee and warranty claims, it is necessary to determine the number of concrete objects actually produced with each mold. For this purpose, it is advantageous if, aside from the number of manufacturing steps or cycles, the manufacturing characteristics, such as acceleration values and the like, can also be determined.

A method of supervising molds, for which the relevant data is collected at the building material machine and assigned administratively, for example, by means of accompanying papers, to the respective mold, does not, however, satisfy the interests of the lessor or the manufacturer of the molds, since there are too many possibilities for manipulating the data and the whole system of supervising the molds is too expensive.

It is therefore an object of the invention to indicate a method of supervising molds of the above-mentioned type as well as an arrangement for carrying out the method, for which the data, collected during the production of the products, can be taken directly from the respective mold and manipulations by unauthorized persons are impossible. The technical means for carrying out the method must be designed and disposed, so that the enormous mechanical stresses, which occur at machines and molds during the production of concrete products, do not have negative effects on the manipulation-free collection and processing of the data and cannot cause damage to the technical facilities required for this purpose.

SUMMARY OF THE INVENTION

After the mold is installed in the computer-controlled building material machine, the actual date is entered in the transponder. Technological data, by means of which the respective mold is identified unambiguously and which is used for setting up and controlling the building material machine, is read from the transponder. This data may contain information concerning formulations and dimensions of the mold and characteristic acceleration and loading values, etc. Before the manufacture of molded objects is commenced, the number of manufacturing cycles, already carried out with this mold, is read from the transponder and used in the computer for monitoring the service life. During the manufacturing process, the actualized cycle number is written back in the transponder after each cycle carried out and stored there in such a manner, that it cannot be manipulated. Likewise, after repairs, important data, such as the date and nature of the respective repair, is recorded in the transponder.

In the event that guarantee or warranty claims are lodged or for the purpose of calculating the lease price, the mold manufacturer, independently of the building material machine, can retrieve the actual manufacturing data from the production mold with an external reader.

In addition, the manufacturer of concrete products can retrieve or supplement selective data for the purpose of keeping an inventory and monitoring the service life. By means of appropriate access controls, it is ensured that it is impossible to manipulate any of the data, important to the manufacturer.

In a special development of the method, the relevant manufacturing data, such as the actual cycle number, is not stored immediately after each cycle in the mold itself. For this purpose, the actual data is read from the transponder by means of a read/write station in each case after the mold is installed in the building material machine and before the manufacturing process is started and stored on an interim basis in the control computer of the building material machine or in a separate computer system. Before the mold is dismantled, the data is then actualized and written back into the transponder.

For carrying out a further development of the method, sensors are disposed at the mold itself. In this case, independently of the control computer, certain manufacturing data, such as the actual cycle number, the shaking energy, etc., are determined directly at the mold, actualized and stored in the transponder so that they cannot be manipulated.

Particularly advantageous examples of arrangements for carrying out the inventive method are described in greater detail with reference to the following drawings, in which like reference numerals designate the same elements.

DETAILED DESCRIPTION OF THE INVENTION

Figure 1:
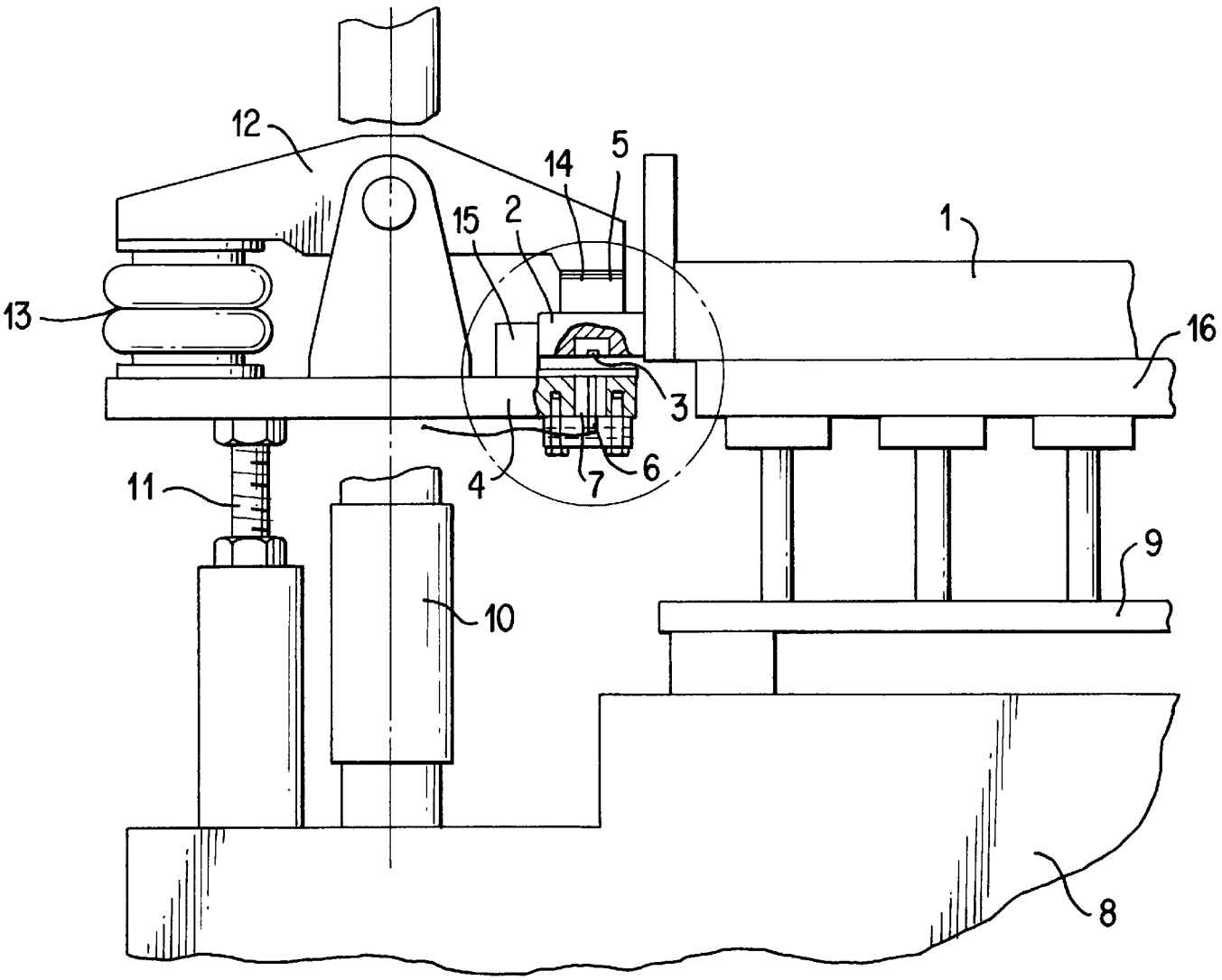
FIG. 1 shows the relevant parts of a board machine.
Figure 2:
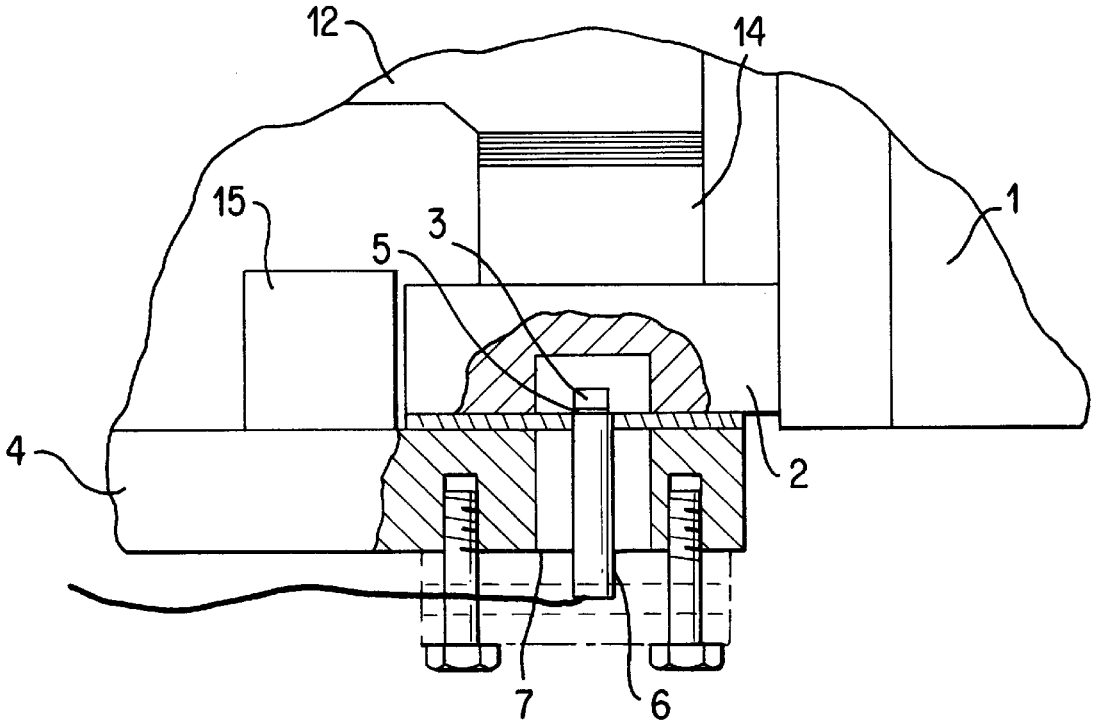
FIG. 2 shows an enlarged detail of FIG. 1.

FIG. 1 shows the relevant parts of a building material machine for mechanically producing molded objects from concrete or building materials of a related type. The example shows a so-called board machine, only one half of the building material machine, viewed in the transporting direction, being shown. A shaking table 9 is disposed on a machine frame 8. A board 16, on which the molded object is molded by means of the mold 1 and transported away, is resting on the shaking table 9. Laterally, viewed in the transporting direction of the board 16, the mold 1 in each case has a mold flange 2, with which the mold 1, after being installed in the building material machine, rests on the mold supports 4. The mold supports 4 can be moved vertically in each case at column guides 10, the range of movement at the bottom being limited by the regulating screws 11. Each mold support 4 has a flexibly mounted device 12 for holding the mold down. At the end of each device 12 for holding the mold down, averted from the mold 1, a damping system 13 is disposed between the device 12 and the mold support 4. At the other end, the device 12 for holding the mold down has clamping elements 14, whereas fixing elements 15 are disposed on the mold support 4. In the representation of FIG. 1, the whole of the arrangement is in the shaking position, that is, the mold flange 2 and the mold support 4 are not in contact. FIG. 2 shows the corresponding components on an enlarged scale in the write/read position.

In a hollow space 5 of a mold flange 2, the transponder 3 is fastened nondetachably and horizontally in the center. This can be accomplished by gluing or casting. In a hollow space 7 in the mold support 4, the write/read head 6 is disposed precisely below the transponder 3. Advantageously, the write/read head 6 is fastened so that it can be exchanged.

For producing molded objects, the mold 1, as described above, is installed in the building material machine so that it rests with its two lateral mold flanges 2 on the mold supports 4. The transponder 3 and the write/read head 6 are now directly one above the other. The write/read head 6 can now activate the transponder 3 in a known manner by an electromagnetic field and read the data stored in it.

After a board 16 has been brought onto the shaking table 9 in the manufacturing position, the mold supports 4 move downward and, with the devices 12 for holding down the mold 1, clamp the latter to the board 16. The mold 1 and the mold support 4 are now at a distance from one another in the shaking position shown in FIG. 1. After the concrete is filled into the mold, it is consolidated by the action of the shaking table 9 and by a load applied, which is not shown in FIG. 1. At the same time, enormous mechanical stresses are exerted on the mold 1. The vertical and horizontal movement of the mold 1 is limited by the device 12 for holding down the mold and by the clamping elements 14 as well as by the fixing elements 15. Since the mold flange 2 and the mold supports 4 are sufficiently far apart, the transponder 3 and the write/read head 6 cannot contact one another and thus cannot suffer damage. At the end of the shaking process, the mold supports 4 once again move upward, so that the mold 1 rests once again with its mold flanges 2 on the mold supports 4. The transponder 3 and the write/read head 6 are once again only such a small distance apart that, for example, the actual cycle number can be recorded in the transponder 3. After the shaking movements, the positional deviations in the x-y direction are least in the horizontal center of the mold flange 2. There are therefore also no horizontal positional deviations between the transponder 3 and the write/read head 6, which could affect data transfer. For demolding the molded object, the mold 1 is moved further upward. After the molded objects have been transported further, a new board 16 can be supplied and a new manufacturing cycle carried out.

Figure 3:
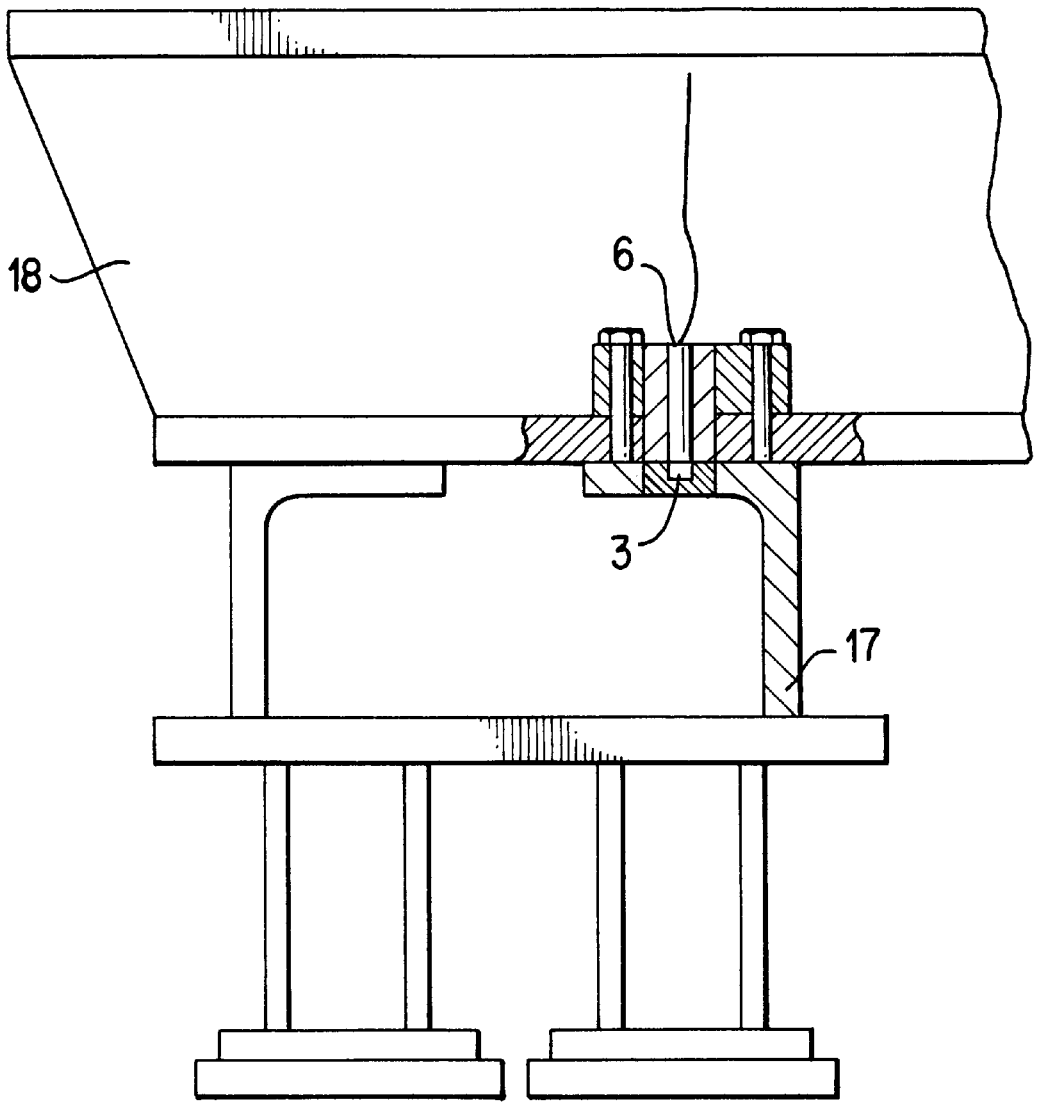
FIG. 3 shows the arrangement of the transponder in a load-applying upper part.

In the example of FIG. 3, the transponder 3 is disposed at the load-applying upper part 17 of the respective mold, while the write/read head 6 is disposed at the building material machine rammer 18 generating the load applied. Since the load-applying upper part 17 and the rammer 18 of the building material machine are fastened together, there is also no impacting contact in this embodiment.

In a further embodiment of the inventive arrangement, which is not shown, the transponder is disposed at an exchangeable mold insert. The associated write/read head is then mounted at the associated mold frame.

With the invention, it is possible to supervise not only molds for so-called board machines. The invention can also be used with multilayer finishers, floor finishers, turning or tilting machines, flow finishers or stone presses.

We claim:

1. A device for supervising molds used for the mechanical production of molded objects of building material and which are received on a building material machine during a filling operation, comprising:

a transponder nondetachably connected with a structural portion of the mold, at least a portion of the transponder being received in a cavity formed in the structural portion;

a write/read head separate from the transponder, the write/read head including means for communicating with the transponder when brought within a minimum communication distance therefrom, disposed, at least during the transfer of data, at a component of the building material machine, the transponder and the write/read head being disposed at respective regions of the mold and the building material machine which are brought into overlaying contact engagement during the filling operation and positioned such that the transponder and the write/read head vertically oppose one another at a distance from one another less than the minimum communication distance during the filling operation; and the building machine including a shaking table on which the mold is supported for shaking thereof during the filling operation.

2. A device according to claim 1, wherein;

the transponder is disposed in a load-applying upper part of the mold; and the write/read head is disposed in a rammer of the building material machine.

3. A device according to claim 1, further comprising:

at least one sensor disposed at the mold for relaying relevant data regarding a mold operation parameter to the transponder; and the transponder being connected with the at least one sensor for storage of the relevant data relayed thereto from the at least one sensor.

4. A device according to claim 1, wherein:

the mold includes a mold flange, the cavity being a hollow space in the mold flange, the transponder being received in the hollow space; and the building material machine including a mold support in which another hollow space is defined in a position below the hollow space in the mold flange when the mold is in a position on the building material machine immediately prior to filling, the write/read head being disposed in the another hollow space in the mold support of the building material machine whereby the write/read head is located below the transponder.

5. A device according to claim 4, wherein:

the transponder is disposed horizontally and centrally in the mold flange; and the write/read head is disposed horizontally and centrally in the mold support.

6. A device for supervising molds used for the mechanical production of molded objects of building material which are received on a building material machine during a filling operation, the building machine including a shaking table on which a respective mold is received and shaken thereby after being filled with the building material to assist in consolidation of the building material in the respective mold, the device comprising:

a transponder nondetachably connected with a structural portion of the mold, at least a portion of the transponder being received in a cavity formed in the structural portion; and a write/read head separate from the transponder, the write/read head being communicative with the transponder when brought within a minimum communication distance therefrom, disposed, at least during the transfer of data, at a component of the building material machine, the respective mold and the building machine being free of structure encumbering at least a degree of horizontal deflection of the respective mold relative the building machine when shaken on the shaking table on which it is received, the transponder and the write/read head being disposed at respective regions of the mold and the building material machine which are brought into overlaying contact engagement during the filling operation and positioned such that the transponder and the write/read head vertically oppose one another at a distance from one another less than the minimum communication distance during the filling operation.

7. A device according to claim 6, wherein:

the mold includes a mold flange, the cavity being a hollow space in the mold flange, the transponder being received in the hollow space; and the building material machine including a mold support in which another hollow space is defined in a position below the hollow space in the mold flange when the mold is in a position on the building material machine immediately prior to filling, the write/read head being disposed in the another hollow space in the mold support of the building material machine whereby the write/read head is located below the transponder.

8. A device according to claim 7, wherein:

the transponder is disposed horizontally and centrally in the mold flange; and the write/read head is disposed horizontally and centrally in the mold support.

9. A device according to claim 6, wherein;

the transponder is disposed in a load-applying upper part of the mold; and the write/read head is disposed in a rammer of the building material machine.

10. A device according to claim 6, further comprising:

at least one sensor disposed at the mold for relaying relevant data regarding a mold operation parameter to the transponder; and the transponder being connected with the at least one sensor for storage of the relevant data relayed thereto from the at least one sensor.

11. In an apparatus for the mechanical production of molded objects of building material which includes a mold and a building material machine on which the mold is received during a filling operation, the building machine including a shaking table on which the mold is supported, the mold being filled with the building material which is introduced in a flowable state and shaken on the shaking table to assist in consolidation of the building material within the mold, the improvement comprising:

a transponder nondetachably connected with a structural portion of the mold, at least a portion of the transponder being received in a cavity formed in the structural portion; and a write/read head separate from the transponder, the write/read head being communicative with the transponder when brought within a minimum communication distance therefrom, disposed, at least during the transfer of data, at a component of the building material machine, the transponder and the write/read head being disposed at respective regions of the mold and the building material machine which are brought into overlaying contact engagement during the filling operation and positioned such that the transponder and the write/read head vertically oppose one another at a distance from one another less than the minimum communication distance during the filling operation.

* * * * *